US010471574B2

(12) United States Patent
Liu

(10) Patent No.: US 10,471,574 B2
(45) Date of Patent: Nov. 12, 2019

(54) POSITIONING DEVICE FOR SOCKET

(71) Applicant: Chao-Chih Liu, Taichung (TW)

(72) Inventor: Chao-Chih Liu, Taichung (TW)

( * ) Notice: Subject to any disclaimer, the term of this patent is extended or adjusted under 35 U.S.C. 154(b) by 167 days.

(21) Appl. No.: 15/859,736

(22) Filed: Jan. 2, 2018

(65) Prior Publication Data

US 2019/0202038 A1 Jul. 4, 2019

(51) Int. Cl.
*B25B 23/00* (2006.01)
*B25B 13/46* (2006.01)

(52) U.S. Cl.
CPC ..... *B25B 23/0035* (2013.01); *B25B 13/462* (2013.01)

(58) Field of Classification Search
CPC ..... B25B 13/462; B25B 23/0035; B25B 23/0007
See application file for complete search history.

(56) References Cited

U.S. PATENT DOCUMENTS

| | | | | |
|---|---|---|---|---|
| 6,845,691 | B2 * | 1/2005 | Hsien | B25B 13/463 81/125 |
| 9,038,506 | B1 * | 5/2015 | Huang | B25B 13/462 81/60 |
| 10,040,177 | B2 * | 8/2018 | Liu | B25B 13/463 |
| 10,058,982 | B2 * | 8/2018 | Hu | B25B 13/463 |
| 10,173,306 | B2 * | 1/2019 | Chou | B25B 23/0035 |
| 2019/0126445 | A1 * | 5/2019 | Molina | B25B 23/0035 |

* cited by examiner

*Primary Examiner* — David B. Thomas

(57) ABSTRACT

A socket includes a first section and a second section which formed at the first end of the first section. The first section includes multiple side faces located on the outside thereof, and a corner portion is formed between each of two adjacent side faces. At least one of the corner portions includes a recess defined therein, and a resilient positioning unit is located in the recess and partially protrudes beyond the open end of the recess. A passage is defined axially through the first and second sections. The resilient positioning unit in the at least one of the corner portions does not affect the feature to secure the socket to the wrench.

5 Claims, 6 Drawing Sheets

POSITIONING DEVICE FOR SOCKET

BACKGROUND OF THE INVENTION

1. Fields of the Invention

The present invention relates to a socket cooperated with a ratchet wrench, and more particularly, to a positioning device for a socket so as to firmly connect the socket with a ratchet wrench.

2. Descriptions of Related Art

The conventional socket as disclosed in FIG. 6 is used to be connected with a ratchet wrench which rotates the socket 40 to loosen or tighten an object such as a bolt or a nut. The socket 40 includes a polygonal section that is inserted into a ratchet wrench. In order to secure the socket 40 to the wrench, a resilient positioning unit 401 is connected one side of the polygonal section. The wrench includes a polygonal mounting hole in which the polygonal section of the socket 40 is inserted, the mounting hole includes an engaging portion which is engaged with the resilient positioning unit 401 so that the socket 40 is connected to the wrench.

However, the resilient positioning unit 401 is connected to one of the multiple sides of the polygonal section of the socket 40, and along with the number of the sides of the polygonal section of the socket 40 increases, the width of each side of the socket 40 is narrower. The narrow side affect the stability of the resilient positioning unit 401 and eventually socket 40 cannot be firmly connected to the wrench when outputting a torque. Besides, the resilient positioning unit 401 will be worn out when it is installed to a narrow side of the socket 40.

The present invention intends to provide a positioning device for a socket to ensure that the socket is firmly connected to a ratchet wrench.

SUMMARY OF THE INVENTION

The present invention relates to a socket and comprises a first section and a second section which formed at the first end of the first section. The first section includes multiple side faces located on the outside thereof, and a corner portion is formed between each of two adjacent side faces. At least one of the corner portions has a recess defined therein, and a resilient positioning unit is located in the recess and partially protrudes beyond an open end of the recess. A passage is defined axially through the first and second sections.

Preferably, the first section includes an annular lip on the second end thereof, and a neck is formed between the annular lip and the second end of the first section.

Preferably, the passage in the first section is a polygonal passage or a rectangular passage, and the passage in the second section is a polygonal passage or a rectangular passage.

Preferably, the second section includes an enlarged section that is integrally formed with the first end of the first section, The outer diameter of the enlarged portion of the second section is greater than that of the first section.

Preferably, two of the corner portions each have a resilient positioning unit connected thereto.

The primary object of the present invention is to provide a positioning device for a socket and the positioning device is located at one of the corner portions between the side faces of the first section of the socket so as to ensure that socket is secured to the wrench, regardless of the number of the side faces formed on the first section.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
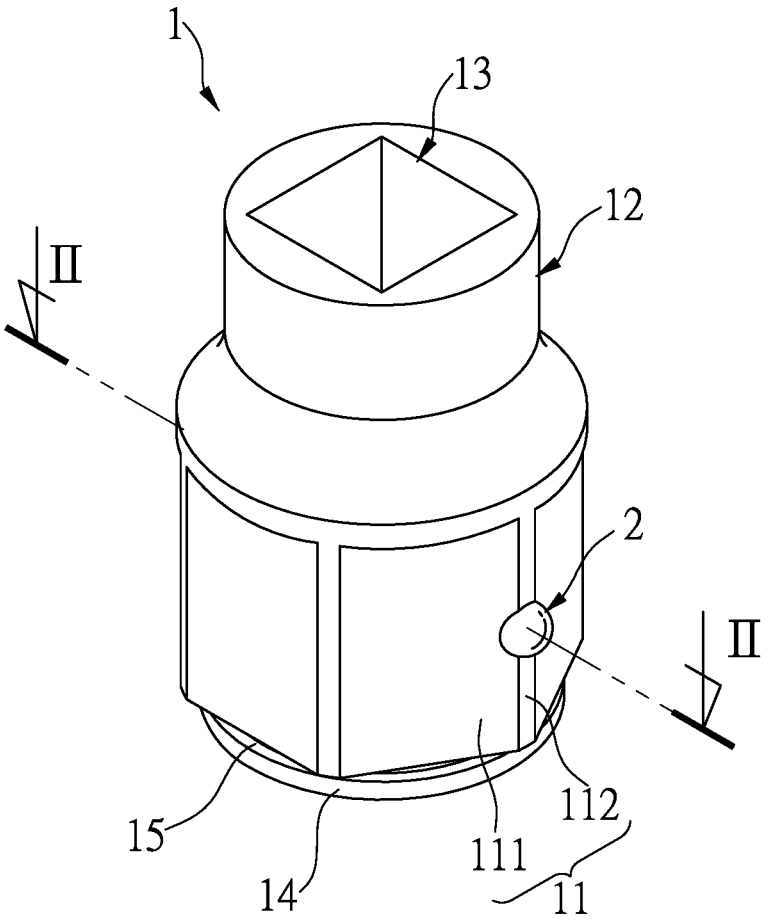
FIG. 1 is a perspective view to show the socket of the present invention.
Figure 2:
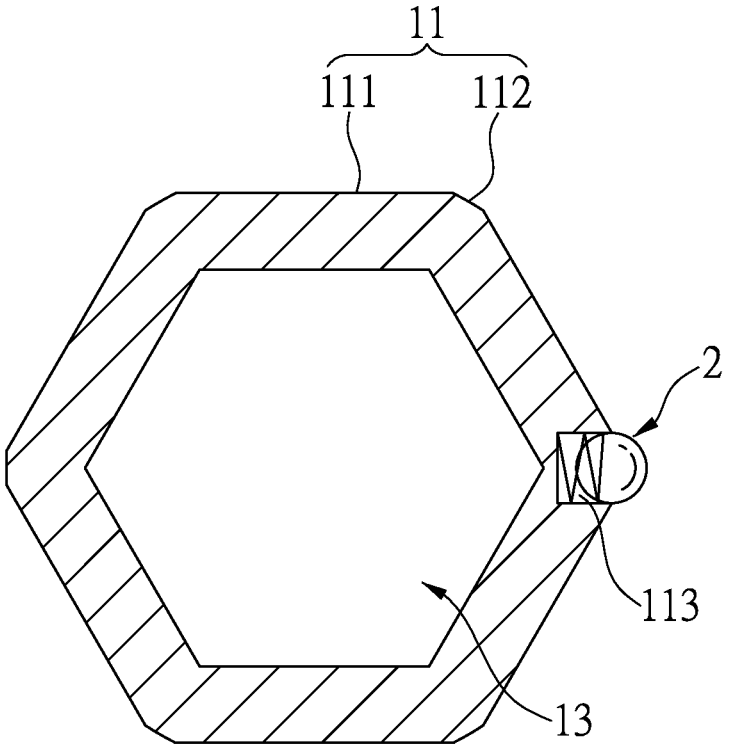
FIG. 2 is a cross sectional view, taken along line II-II in FIG. 1.

Referring to FIGS. 1 to 4, the socket 1 of the present invention comprises a first section 11 and a second section 12 which formed at the first end of the first section 11. The first section 11 includes multiple side faces 111 located on the outside thereof, and a corner portion 112 is formed between each of two adjacent side faces 111. The second section 12 includes an enlarged portion that is integrally formed with the first end of the first section 11. The outer diameter of the enlarged portion of the second section 12 is greater than that of the first section 11. At least one of the corner portions 112 has a recess 113 defined therein. A resilient positioning unit 2 is located in the recess 113 and partially protrudes beyond an open end of the recess 113. The resilient positioning unit 2 is composed of a spring and a ball which partially protrudes beyond an open end of the recess 13. A passage 13 is defined axially through the first and second sections 11, 12. The resilient positioning unit 2 is located in the recess 113 that is located at one of the corner portions 112 so that the number of the side faces 111 on the first section 11 does not affect the engagement between the resilient positioning unit 2 and the wrench which will be mentioned later.

The first section 11 includes an annular lip 14 on the second end thereof, and a neck 15 is formed between the annular lip 14 and the second end of the first section 11.

Figure 3:
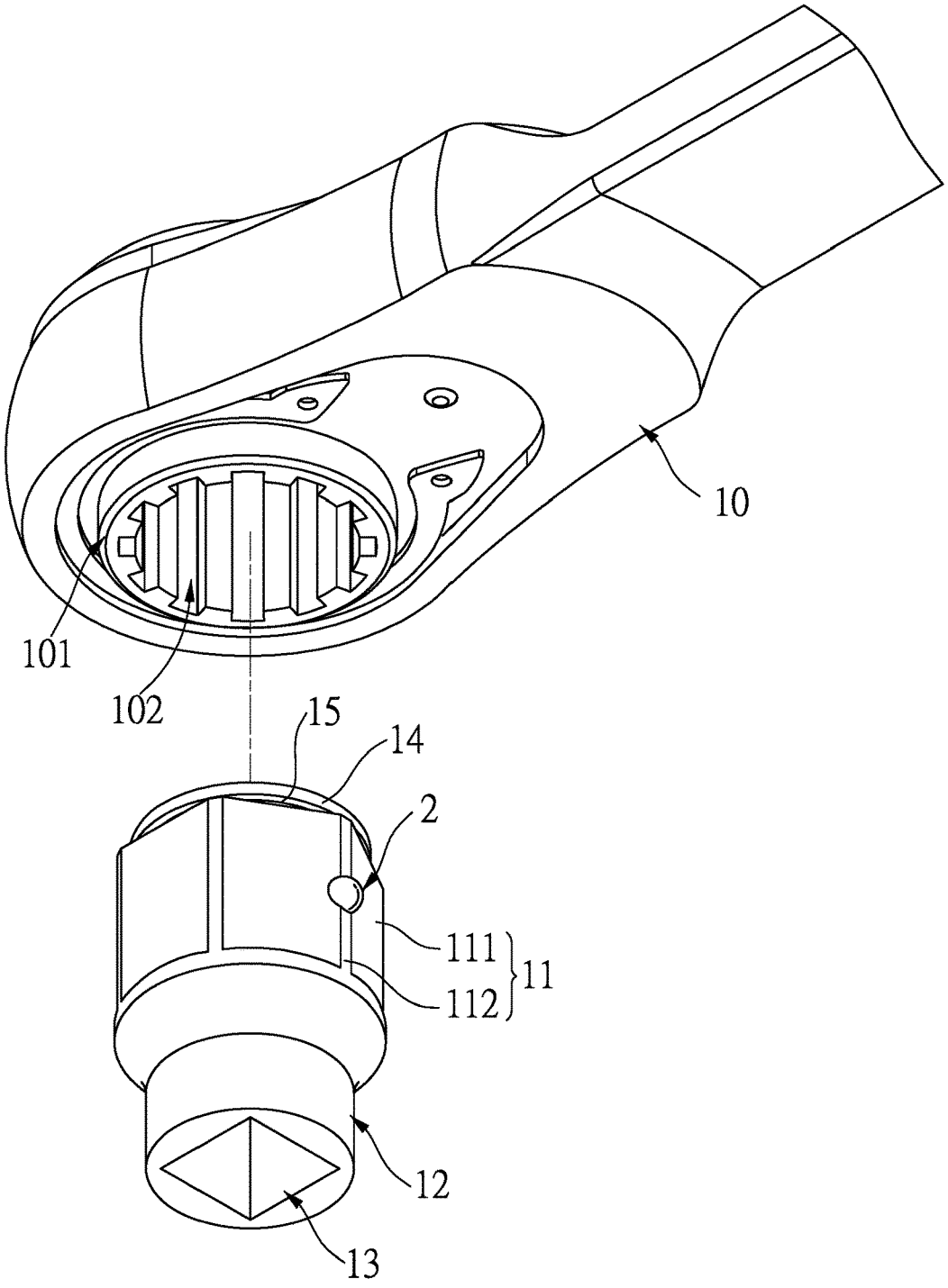
FIG. 3 shows that the socket of the present invention is to be connected to a ratchet wrench.

As shown in FIG. 3, when using a ratchet wrench 10 to be connected to the socket 1 of the present invention, the ratchet wrench 10 includes a driving ring 101 which includes a mounting hole 102. The first section 11 is inserted into the mounting hole 102 and the toothed inner periphery of the driving ring 101 is engaged with the side faces 111. The ball of the resilient positioning unit 2 is engaged with the notch (not shown) of the ratchet wrench 10. It is noted that because the resilient positioning unit 2 is located in the recess 113 that is located at one of the corner portions 112 so that the number of the side faces 111 on the first section 11, or the width of each side face 111 does not affect the engagement between the resilient positioning unit 2 and the ratchet wrench 10. The C-shaped clip (not shown) in the ratchet wrench 10 is engaged with the neck 15 to further position the socket 1 relative to the ratchet wrench 10. Because the outer diameter of the enlarged portion of the second section 2 is greater than that of the first section 11 so that the driving ring 101 of the ratchet wrench 10 will contact the enlarged portion of the second section 12 to restrict the depth that the first section 11 in the ratchet wrench 10.

Figure 4:
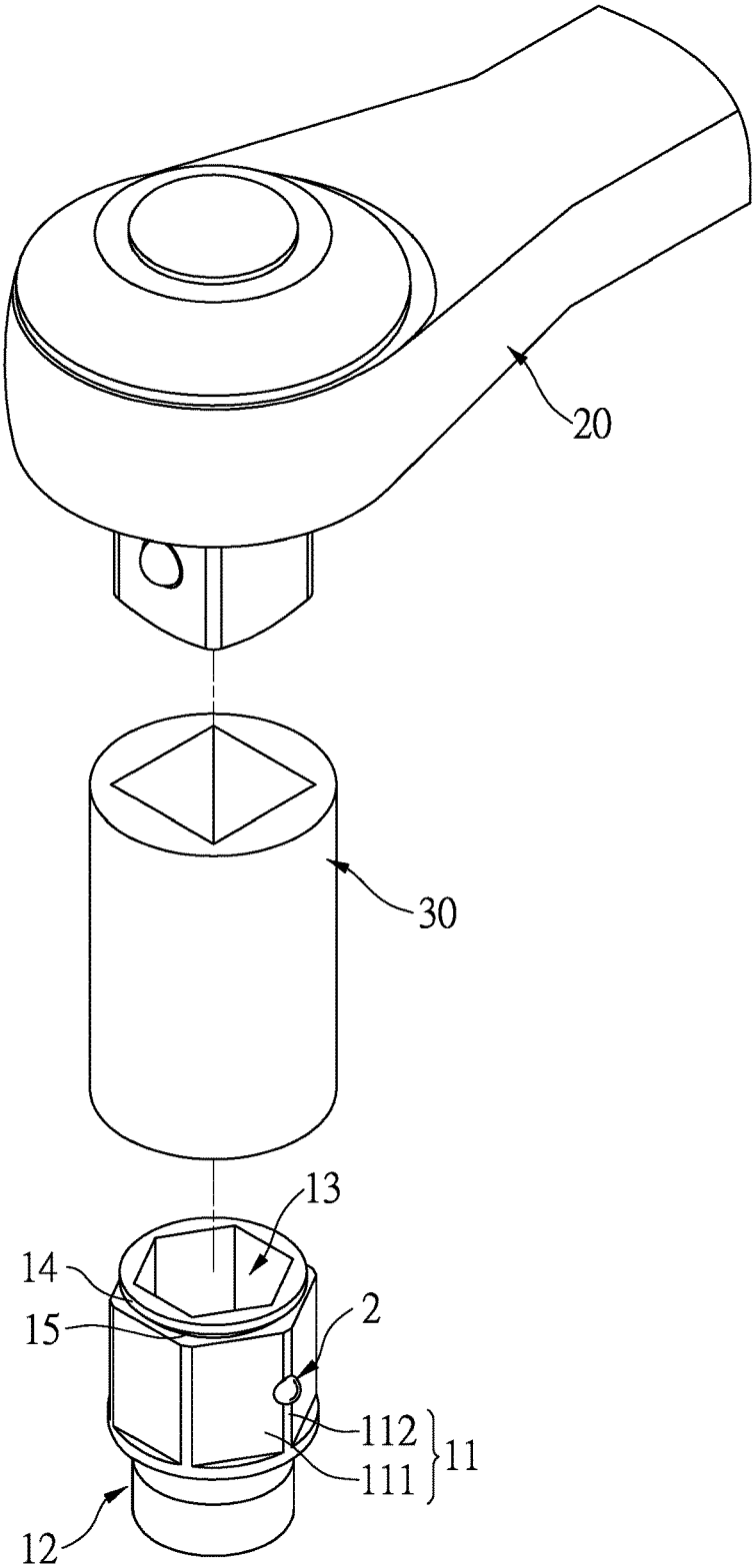
FIG. 4 shows that the socket of the present invention is to be connected to another ratchet wrench by a connection socket.

FIG. 4 shows another ratchet wrench 20 that includes a rectangular driving protrusion which is connected to a conventional socket 30, and the first section 11 of the socket 1 of the present invention is connect to the conventional socket 30. It is noted that the passage 13 in the first section 11 is a polygonal passage or a rectangular passage, and the passage 13 in the second section 12 is a polygonal passage or a rectangular passage. Therefore, the socket 1 of the present invention can be cooperated with different types of wrenches.

Figure 5:
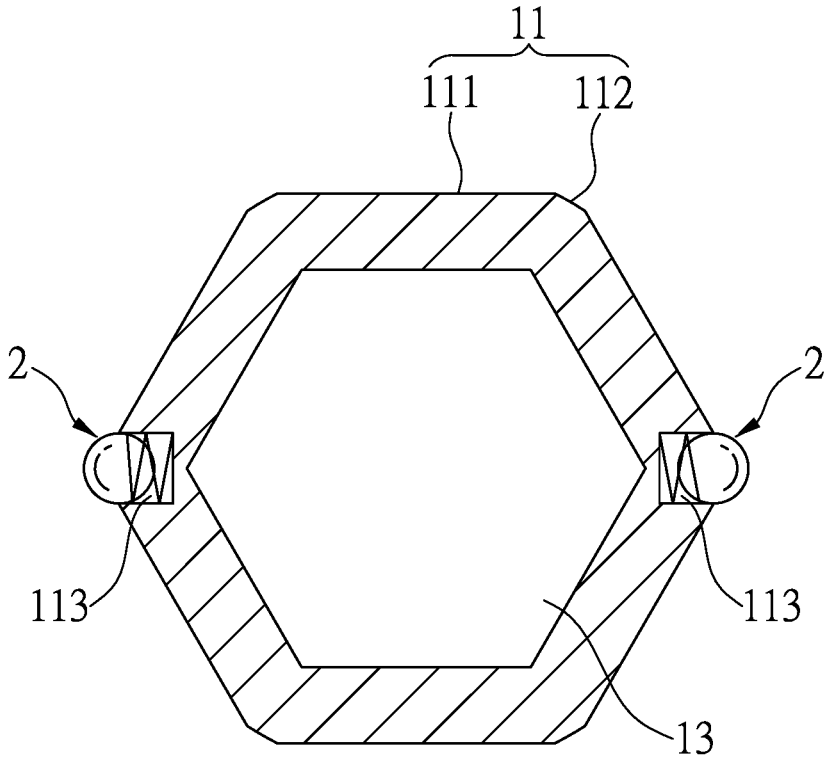
FIG. 5 is an cross sectional view to show that two resilient positioning units are connected to the socket of the present invention.
Figure 6:
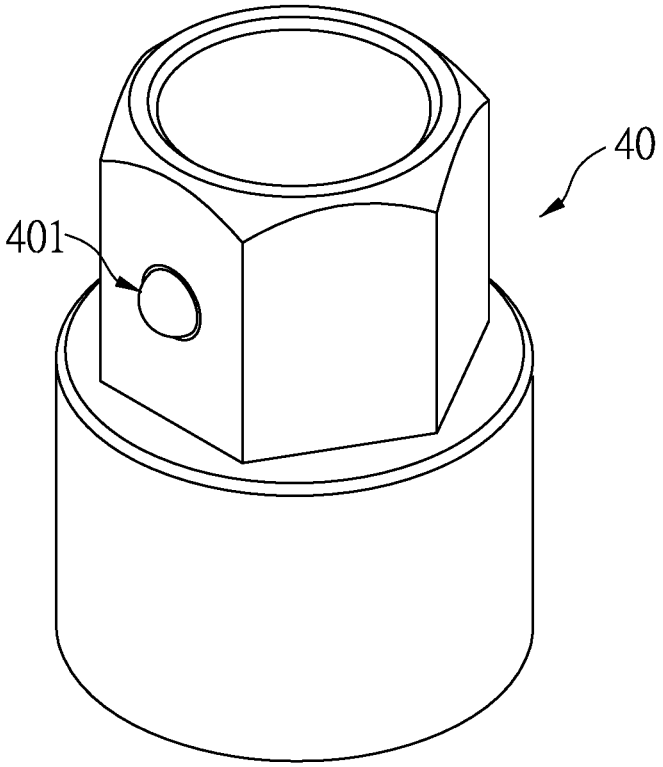
FIG.6 (Prior art)
FIG. 6 shows the conventional socket.

FIG. 5 shows that there are two resilient positioning units 2 connected to the first section 11 of the socket 1, and the two resilient positioning units 2 are located diametrically opposite to each other.

While we have shown and described the embodiment in accordance with the present invention, it should be clear to those skilled in the art that further embodiments may be made without departing from the scope of the present invention.

What is claimed is:

1. A socket comprising:

a first section and a second section which formed at a first end of the first section, the first section including multiple side faces located on an outside thereof, a corner portion formed between each of two adjacent side faces, at least one of the corner portions having a recess defined therein, a resilient positioning unit located in the recess and partially protruding beyond an open end of the recess, a passage defined axially through the first and second sections.

2. The socket as claimed in claim 1, wherein the first section includes an annular lip on a second end thereof, and a neck is formed between the annular lip and the second end of the first section.

3. The socket as claimed in claim 1, wherein the passage in the first section is a polygonal passage or a rectangular passage, the passage in the second section is a polygonal passage or a rectangular passage.

4. The socket as claimed in claim 3, wherein the second section includes an enlarged portion that is integrally formed with the first end of the first section, an outer diameter of the enlarged portion of the second section is greater than that of the first section.

5. The socket as claimed in claim 4, wherein two of the corner portions each have a resilient positioning unit connected thereto.

* * * * *